US011435040B2

(12) United States Patent
Weissman et al.

(10) Patent No.: US 11,435,040 B2
(45) Date of Patent: Sep. 6, 2022

(54) ILLUMINATED INFLATABLE DECORATION

(71) Applicant: AIRDD, LLC, North Hollywood, CA (US)

(72) Inventors: Zeev Weissman, Plantation, FL (US); Niclas Henning Zieger, Pasadena, CA (US)

(73) Assignee: AIRDD LLC, North Hollywood (CA)

( * ) Notice: Subject to any disclaimer, the term of this patent is extended or adjusted under 35 U.S.C. 154(b) by 0 days.

(21) Appl. No.: 17/172,337

(22) Filed: Feb. 10, 2021

(65) Prior Publication Data

US 2021/0254802 A1 Aug. 19, 2021

Related U.S. Application Data

(60) Provisional application No. 62/976,116, filed on Feb. 13, 2020.

(51) Int. Cl.

| | |
|---|---|
| ***F21S 9/02*** | (2006.01) |
| ***F21V 23/04*** | (2006.01) |
| ***F21V 17/00*** | (2006.01) |
| ***F21V 17/10*** | (2006.01) |
| ***F21Y 115/10*** | (2016.01) |
| ***F21V 3/02*** | (2006.01) |
| *F21W 121/00* | (2006.01) |
| *F21Y 113/10* | (2016.01) |

(52) U.S. Cl.

CPC *F21S 9/02* (2013.01); *F21V 3/02* (2013.01); *F21V 17/002* (2013.01); *F21V 17/105* (2013.01); *F21V 23/0435* (2013.01); *F21W 2121/00* (2013.01); *F21Y 2113/10* (2016.08); *F21Y 2115/10* (2016.08)

(58) Field of Classification Search

CPC ..... A63H 3/006; A63H 2027/1033; F21V 17/105

See application file for complete search history.

(56) References Cited

U.S. PATENT DOCUMENTS

| | | | | |
|---|---|---|---|---|
| 3,670,440 | A | 6/1972 | Yost | |
| 3,672,083 | A | 6/1972 | Moran | |
| 3,745,677 | A | 7/1973 | Moran | |
| 6,352,355 | B1 * | 3/2002 | Law | D04D 9/04 362/234 |
| 7,216,446 | B2 | 5/2007 | Machaia | |
| 7,302,769 | B2 | 12/2007 | Yost | |

(Continued)

*Primary Examiner* — Eric T Eide

(74) *Attorney, Agent, or Firm* — Diederiks & Whitelaw, PLC.

(57) ABSTRACT

An illuminated inflatable decoration comprises a base unit including a housing. The inflatable decoration includes a rechargeable battery located in the housing. In addition, a fan and a light source are arranged to draw power from the rechargeable battery. An inflatable element is removably connected to the base unit and configured to be expanded into a semi-rigid shape when filled with pressurized air from the fan. The inflatable decoration includes a controller configured to receive commands from a remote-control unit and control the operation of the fan and the light source. With this arrangement, customers will be able to incorporate illuminated inflatable elements into their event design décor scheme without the need for a power feed.

20 Claims, 10 Drawing Sheets

(56) References Cited

U.S. PATENT DOCUMENTS

| | | | | |
|---|---|---|---|---|
| 7,322,137 | B2 | 1/2008 | Machaia | |
| 8,635,794 | B1 | 1/2014 | Thigpen et al. | |
| 9,364,113 | B2 | 6/2016 | Gary | |
| 2002/0111109 | A1 | 8/2002 | Kwan | |
| 2006/0111011 | A1 | 5/2006 | Wang | |
| 2006/0230655 | A1 | 10/2006 | Machaia | |
| 2006/0291217 | A1 | 12/2006 | Vanderschuit | |
| 2014/0091951 | A1* | 4/2014 | Miller | E01F 9/615 340/908 |
| 2018/0112851 | A1* | 4/2018 | Haungs | F21V 17/105 |
| 2018/0340661 | A1* | 11/2018 | Inskeep | F21L 4/085 |
| 2020/0275751 | A1* | 9/2020 | Jirak | A45C 13/02 |
| 2020/0316620 | A1* | 10/2020 | Xu | B05B 17/08 |

* cited by examiner

ILLUMINATED INFLATABLE DECORATION

CROSS REFERENCE TO RELATED APPLICATIONS

This application claims benefit of U.S. Provisional Patent Application No. 62/976,116 which was filed on Feb. 13, 2020 and titled "Illuminated Inflatable Decoration". The entire content of this application is incorporated herein by reference.

BACKGROUND OF THE INVENTION

The present invention relates to illuminated decorations that are inflatable, preferably by supplying pressurized air to a flexible fabric body, which can be formed in numerous desirable shapes.

Inflatable decorations have a wide range of applications. For instance, inflatable decorations have been employed as figures for holidays, as seasonal decorations, in marketing and as event attractions. Illuminated inflatable decorations have been popular in events hosted by industries for over 30 years. Such decorations are designed to be used in events, such as the Olympics, Super-Bowl Half Time Shows, World Expos, Award Shows, Television Productions, corporate and social events, and other public and private events.

Typical prior art figures have been formed as static balloons which are blown up and set in place. However, such balloons must be carefully sealed after inflation. Even with careful sealing, the balloons tend to leak and are affected by environmental factors. For example, the balloons tend to become underinflated in cold weather and overinflated in hot weather. The balloons also can be disturbed by wind or rain.

One solution to the problems presented by the static balloons is to simply use the balloons inside a building or have them tied down. Another suggested solution has been to use continuously inflated figures, typically formed of separate inflatable elements. Such figures employ fans that continuously blow air into the inflatable elements. The continuously inflated figures have presented their own set of problems. For example, all of the continuously inflated figures require a constant power source in the form of an electricity feed. Customers who use these products need a power source for each inflatable element. Such continuously inflated figures may be set up in different configurations including a standing configuration on a floor or table, or they may be suspended from a ceiling. Running power feeds to the inflatable elements is a time consuming, cumbersome and costly task. In some cases, setting up the electric feeds at the designated locations is not even feasible and, therefore, customers may elect not to use the continuously inflated figures.

There is a need in the art for an inflatable illuminated decoration that does not suffer from the deficiencies listed above and may be used in numerous different locations not having a readily available source of electrical power.

SUMMARY OF THE INVENTION

The present invention is directed to an illuminated inflatable decoration comprising a base unit including a housing. The inflatable decoration includes a rechargeable battery located in the housing. In addition, a fan and a light source are arranged to draw power from the rechargeable battery. An inflatable element is removably connected to the base unit and is configured to be expanded into a semi-rigid shape when filled with pressurized air from the fan. The inflatable decoration includes a controller configured to receive commands from a remote-control unit and to control the operation of the fan and the light source. With this arrangement, customers will be able to incorporate illuminated inflatable elements into their event design décor scheme without the need for a power feed.

The inflatable decoration offers multiple usage configurations. In a first preferred embodiment, the base unit has a bottom surface configured to be supported or otherwise placed on a flat surface and an upper surface with an airtight seal connected to the inflatable element. In this upright or standing configuration, the decoration is preferably placed on a flat surface and used as a centerpiece on tables, bar-tops, countertops, etc.

In a second preferred embodiment, the inflatable decoration is mounted in an inverted and/or suspended configuration. The decoration is provided with a folding hook mounted to the base unit and configured to connect to a support. The decoration can then be hung from a support, such as a ceiling or, other overhead supports, like trees, trusses, floor stands, etc.

In a third preferred embodiment, the inflatable decoration is mounted on a floating support. The floating support has a top surface containing magnets and the base unit also has magnets configured to engage the magnets contained in the floating support to secure the base to the floating support. The inflatable decoration can be used as decoration for a pool, lake or another body of water.

There are several other advantageous features associated with the inflatable decoration. For example, a plurality of interchangeable design covers may be employed. Any one of the plurality of interchangeable design covers may be attached to the base with a fastener such as a VELCRO fastener. This feature allows for customers to use design covers from a standard, off-the-shelf line of covers or to request a custom cover for their own design needs. Preferably, the battery provides more than 8 hours of operation for the light source and the fan before requiring recharging, which allows for a full workday of operation. Also, the battery allows for easy set-up and operation since no wire needs to be run to power the inflatable decorations.

A remote-control unit is preferably employed to control the inflatable decorations. The light source produces different colors of light and the controller is configured to enable a user to select one of the different colors of light with the remote-control unit. In addition, the controller is configured to turn the decoration on or off based on commands received from the remote control. Other options, such as having the colors rotate or dim, are also controlled by the remote-control unit. The light source includes an LED based lighting bulb configured to illuminate the inflatable element with multiple colors. The lightning bulb provides complete lighting coverage and illumination of the inflatable design element with multiple solid color choices, as well as color effect options which, once again, can be controlled remotely. Preferably, the inflatable element includes a fire-retardant inflatable fabric.

Additional objects, features and advantages of the present invention will become more readily apparent from the following detailed description of preferred embodiments when taken in conjunction with the drawings wherein like reference numerals refer to corresponding parts in the several views.

BRIEF DESCRIPTION OF THE DRAWINGS

The disclosure may be more completely understood in consideration of the following description of various illustrative embodiments in connection with the accompanying drawings.

DETAILED DESCRIPTION OF THE PREFERRED EMBODIMENTS

Figure 1:
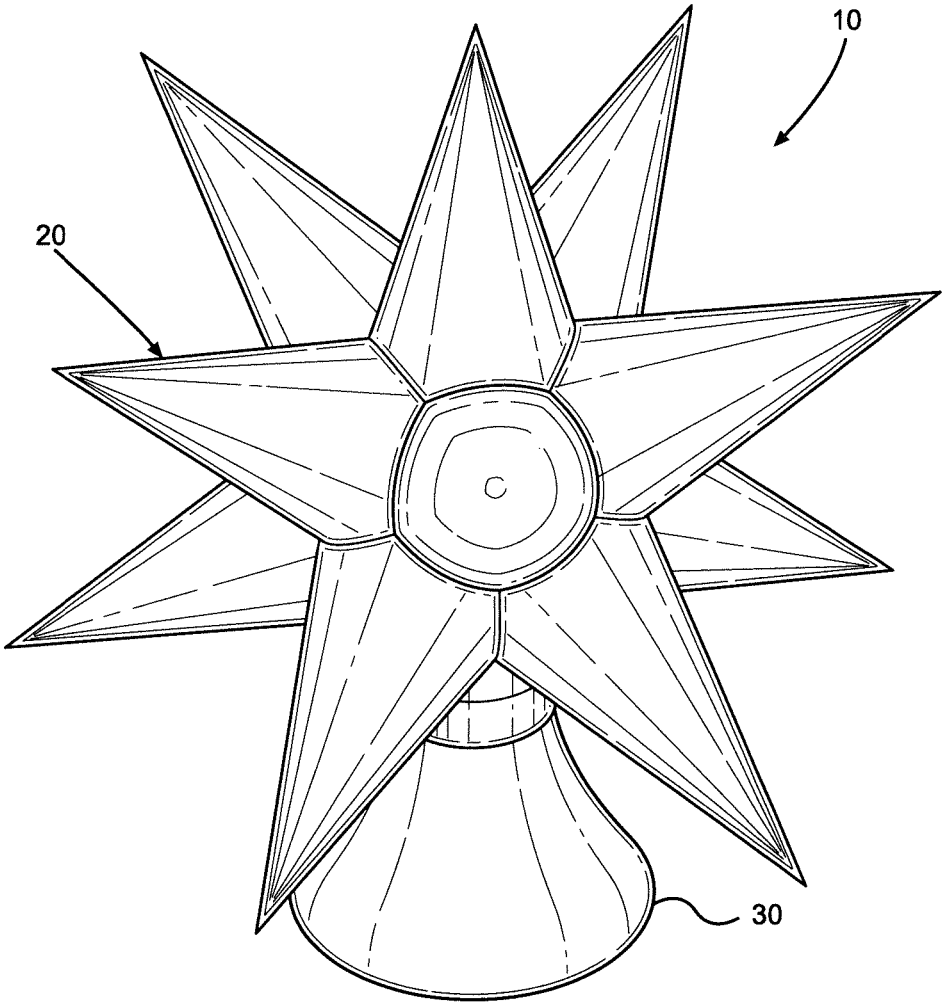
FIG. 1 is an isometric view of an inflatable decoration set up in a freestanding configuration according to a first preferred embodiment of the invention.

The following detailed description should be read with reference to the drawings in which similar elements in different drawings are numbered the same. The detailed description and the drawings, which are not necessarily to scale, depict illustrative embodiments and are not intended to limit the scope of the disclosure. The illustrative embodiments depicted are intended only as exemplary. Selected features of any illustrative embodiment may be incorporated into an additional embodiment unless clearly stated to the contrary. While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

As used in this specification and the appended claims, the singular forms "a", "an" and "the" include plural forms unless the content clearly dictates otherwise. As used in this specification and the appended claims, the term "or" is generally employed in its sense including "and/or" unless the content clearly dictates otherwise.

FIG. 1 shows an isometric view of an illuminated inflatable decoration 10 having an inflatable element 20 and a base unit 30. Inflatable element 20 is preferably made of a ripstop nylon but may be made of any type of flexible material that retains pressurized air. Preferably the material is fire retardant. Inflatable element 20 is shown in a star shape. However, any decorative shape could be employed. See, for example, the shapes disclosed in U.S. Pat. No. 8,635,794 and US Patent Application Publication No. 2006/0291217, the contents of which are incorporated herein by reference. Inflatable decoration 10 is shown in an upright configuration wherein base unit 30 may be placed on a floor or table, or any other relatively flat and level surface.

Figure 2:
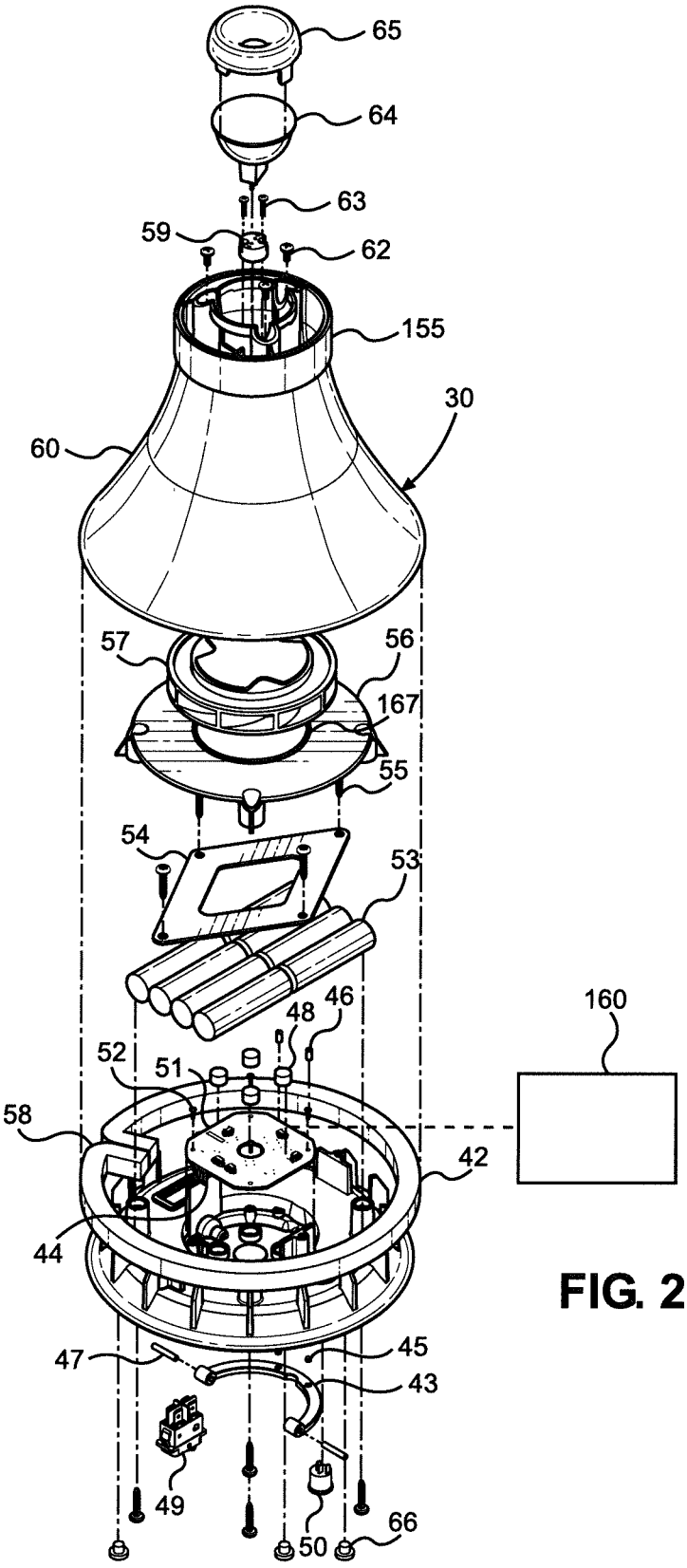
FIG. 2 is an exploded view of a base unit of the inflatable decoration of FIG. 1.
Figure 3:
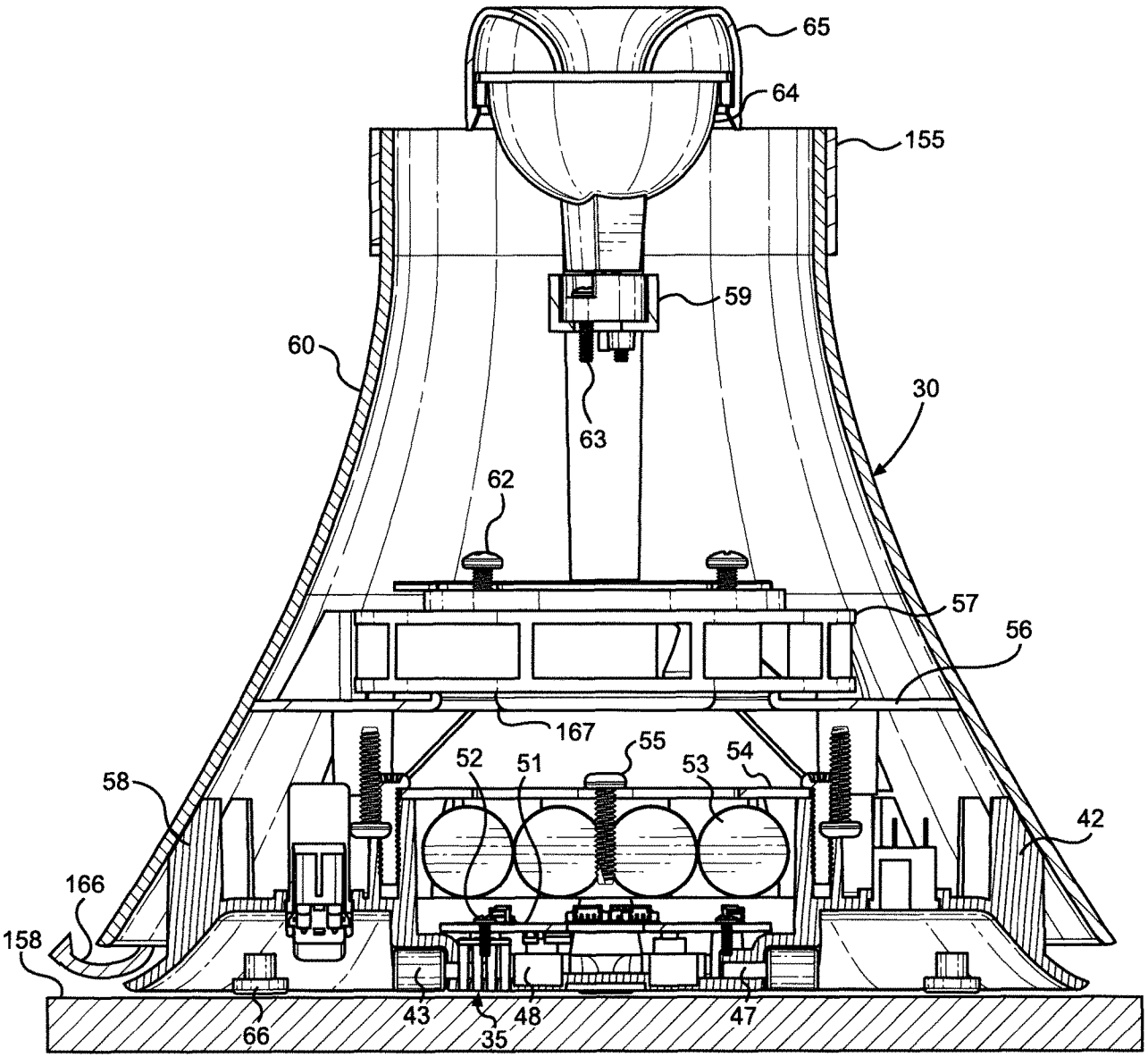
FIG. 3 is cross section of the base unit of the inflatable decoration of FIG. 1 shown on a support surface.
Figure 6:
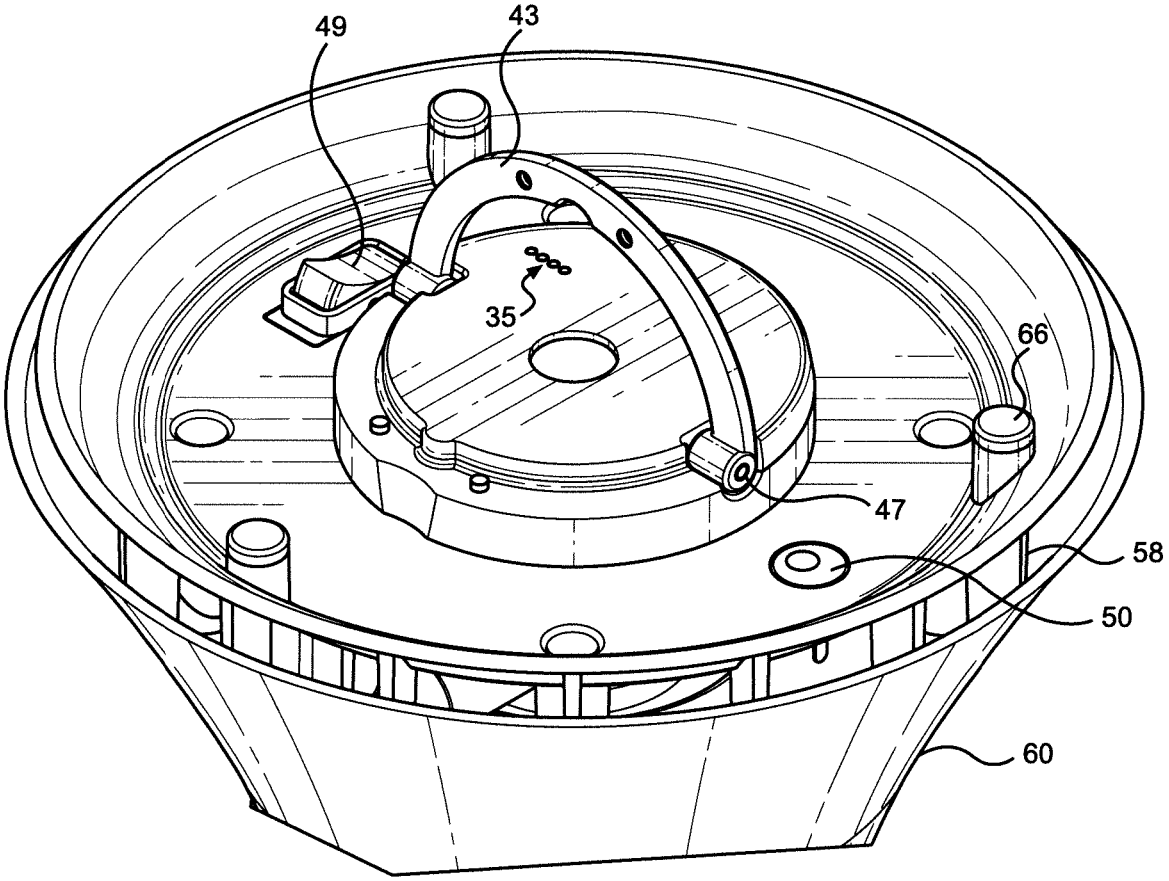
FIG. 6 is a bottom view of a base unit of an inflatable decoration with a mounting hook rotated to be engaged when the inflatable decoration of FIG. 1 is in a suspended configuration.
Figure 7:
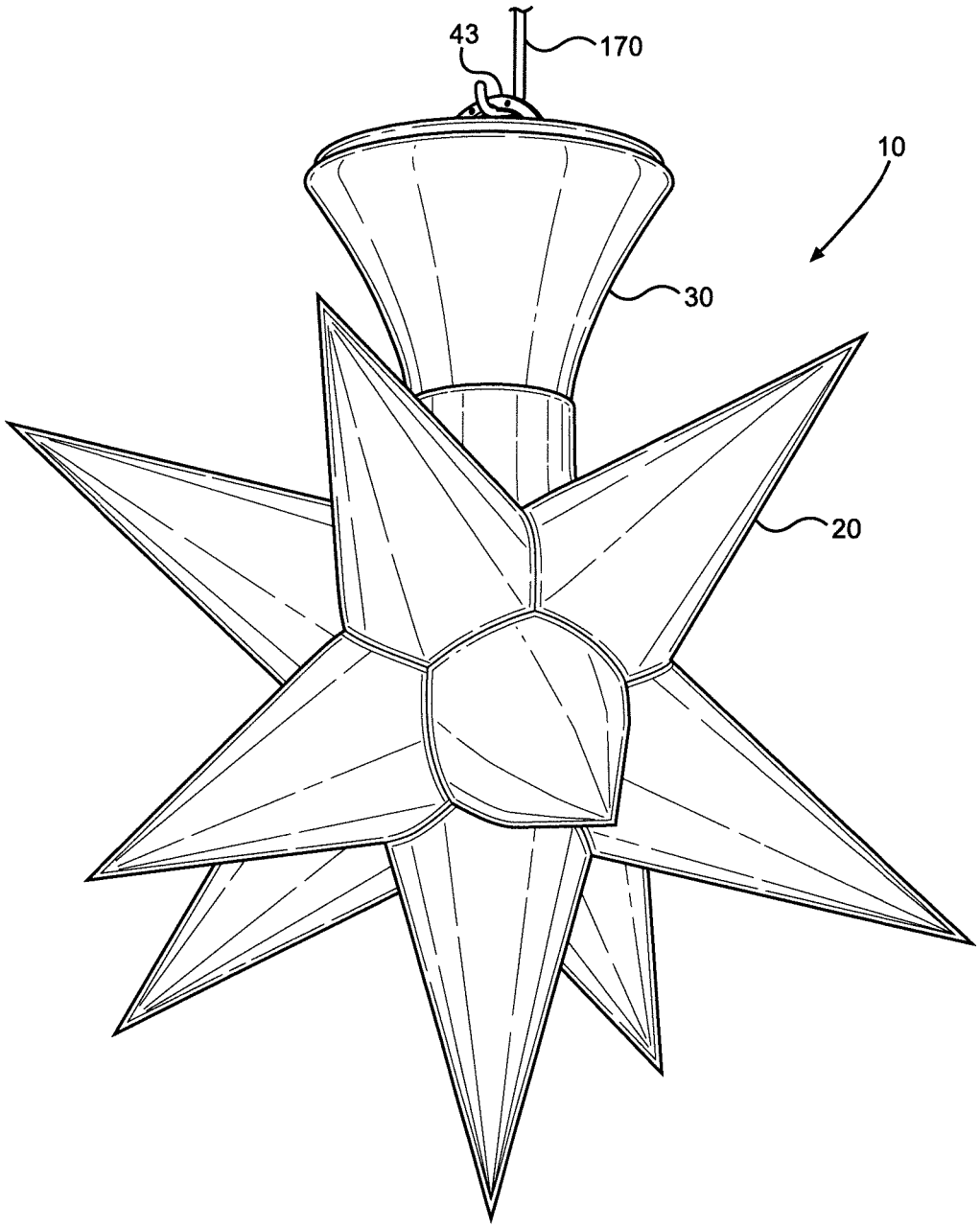
FIG. 7 is an isometric view of the inflatable decoration of FIG. 6 connected to a support.

Base unit 30 will now be described with reference to FIGS. 2 and 3. FIG. 2 shows an exploded view of base unit 30, while FIG. 3 shows a cut-away view of base unit 30. For clarity, inflatable element 20 is not shown. A battery charge indicator 35 (discussed more fully below) is provided in base 30. A lower housing 42 is provided with a folding hook 43. Folding hook 43 is shown as a curved member that is pivotable from a stowed configuration shown in FIGS. 1 and 4 to a deployed configuration as shown in FIGS. 6 and 7. Folding hook 43 is stowed when inflatable decoration 10 is in the upright configuration and deployed to engage a support when inflatable decoration 10 is in a suspended configuration.

An LED lighting pipe or tunnel 44 is mounted on lower housing 42. Several sets of magnets 45, 46 and 48 are also provided in lower housing 42. More precisely, magnets 45 are located on folding hook 43. An on/off switch 49 is mounted on the bottom surface of lower housing 42. Switch 49 is preferably a rocker switch that may be used to manually turn on inflatable decoration 10. A jack 50 is also mounted on the bottom surface of lower housing 42 and provides a way to provide power to inflatable decoration 10. A printed circuit board 51 is located within lower housing 42. Screws 52 are provided to removably mount printed circuit board 51 on lower housing 42. Printed circuit board 51 acts as the overall controller for inflatable decoration 10 and is connected to switch 49 and jack 50 through the bottom surface of lower housing 42.

Above printed circuit board 51, there is located a rechargeable battery pack 53 held in place by a battery plate 54 secured by screws 55. Battery pack 53 is connected to printed circuit board 51. Printed circuit board 51 controls charging of battery pack 53 when jack 50 is connected to a power source (not shown).

Above battery plate 54 is located a fan housing 56 supporting a fan 57. A socket 59 is mounted at a top portion of a top housing 60 and receives a light bulb 64. Fasteners 62 secure battery plate 54 and fasteners 63 secure socket 59. A diffuser 65 is mounted over light bulb 64 and diffuses light produced by bulb 64. Preferably, fan 57 is a centrifugal fan that spins to pull a flow of air upward through fan housing 56 and then radially outward, where the flow turns and follows the inside of top housing 60 and around socket 59.

Figure 4:
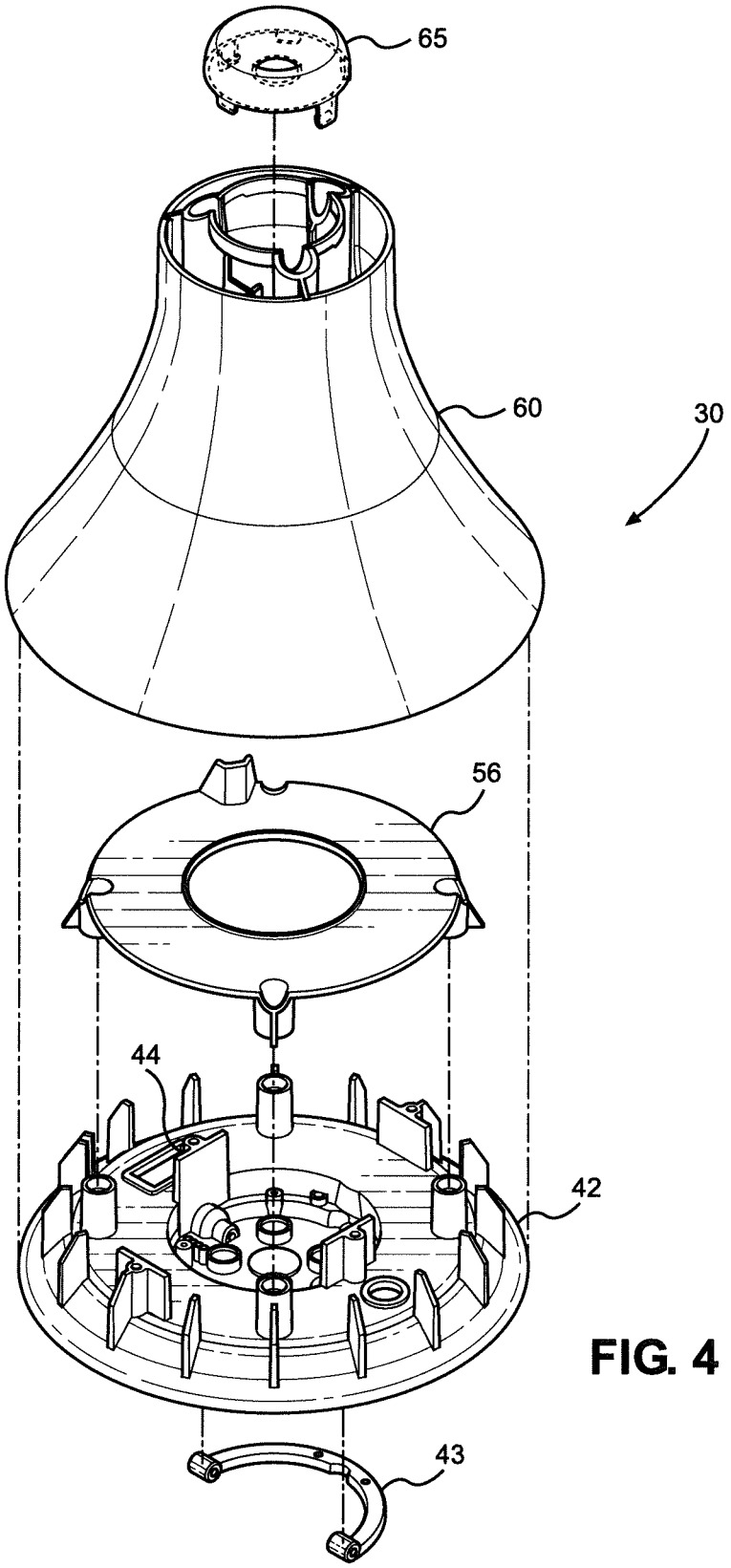
FIG. 4 is a partial exploded view of the base unit of the inflatable decoration of FIG. 1.
Figure 5:
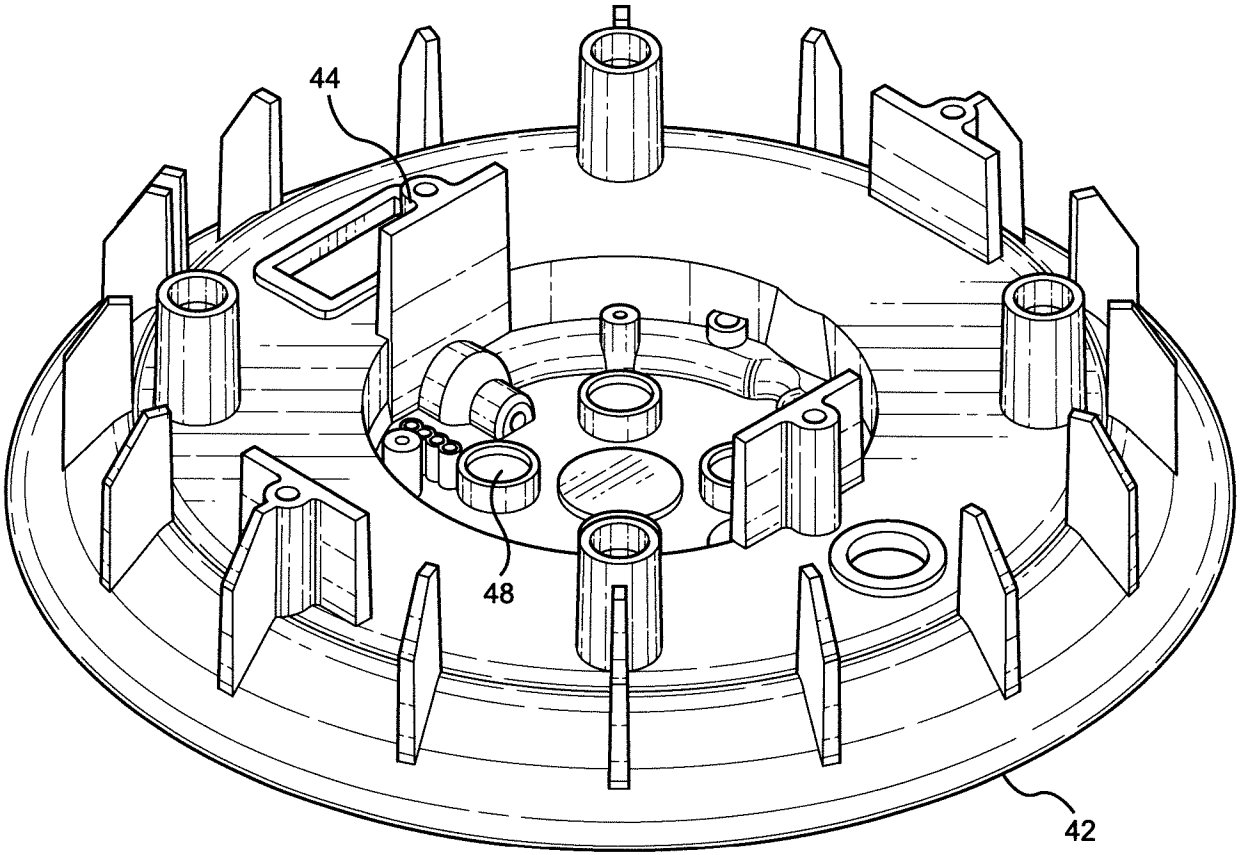
FIG. 5 is an isometric view of a housing of the base unit of FIG. 1.

FIG. 4 shows an expanded view of base unit 30 with only lower housing 42, fan housing 56 and upper housing 60 being shown, along with diffuser 65 and folding hook 43. FIG. 5 shows lower housing 42 in more detail, such as how fan housing 56 cooperates with lower housing 42. LED tunnel 44 and magnets 48 are more clearly shown.

FIGS. 6 and 7 show how inflatable decoration 10 can be employed in a suspended configuration. Folding hook 43 is shown in its deployed configuration ready to be attached to a support such as a ceiling. FIG. 7 shows inflatable decoration 10 upside-down. As best seen in FIG. 7, battery charge indicator 35 has four lights that indicate the charge level of battery pack 53. A red light indicates 0%-25% charge, an orange light indicates 25%-50% charge, a first green light indicates at least a 50% charge, and a second green light indicates 100% charge.

Figure 8:
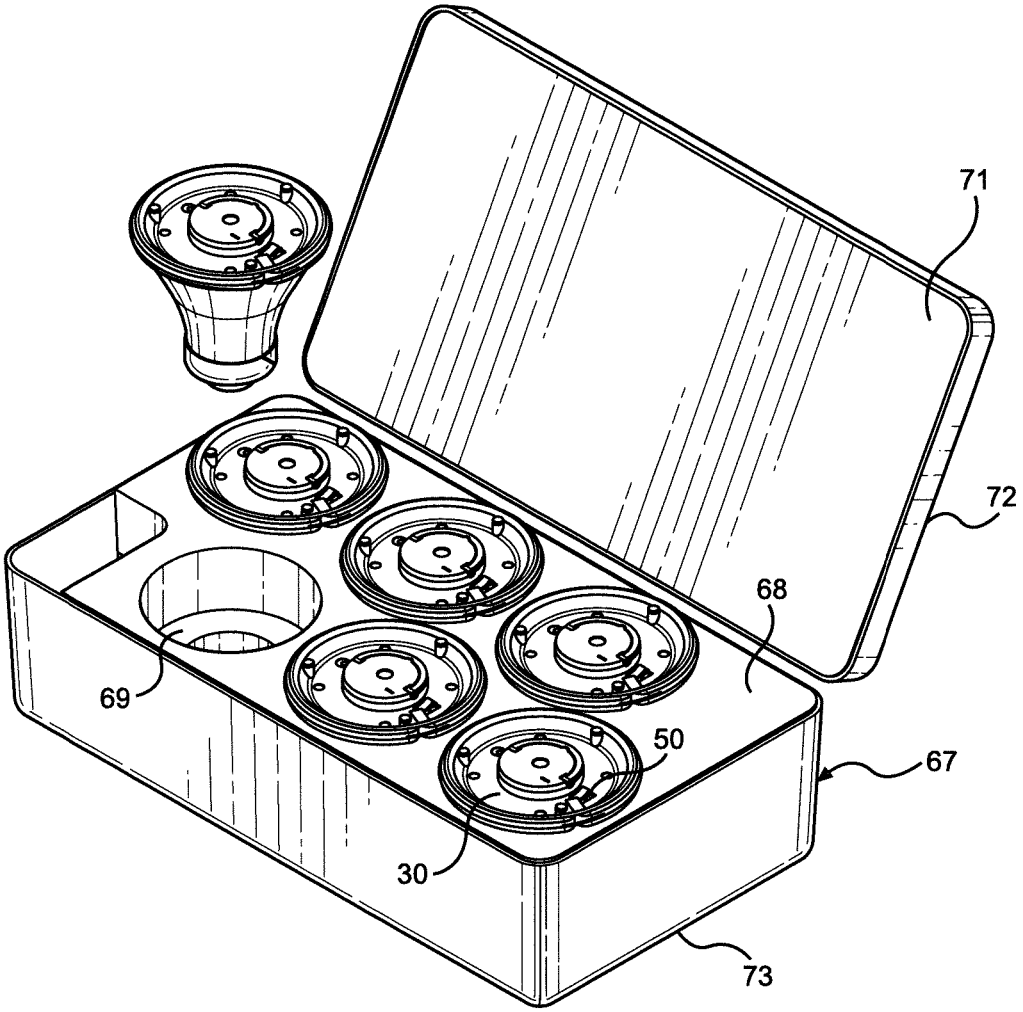
FIG. 8 is an isometric view of a case for transporting base units employed in the inflatable decoration of FIG. 1.
Figure 9:
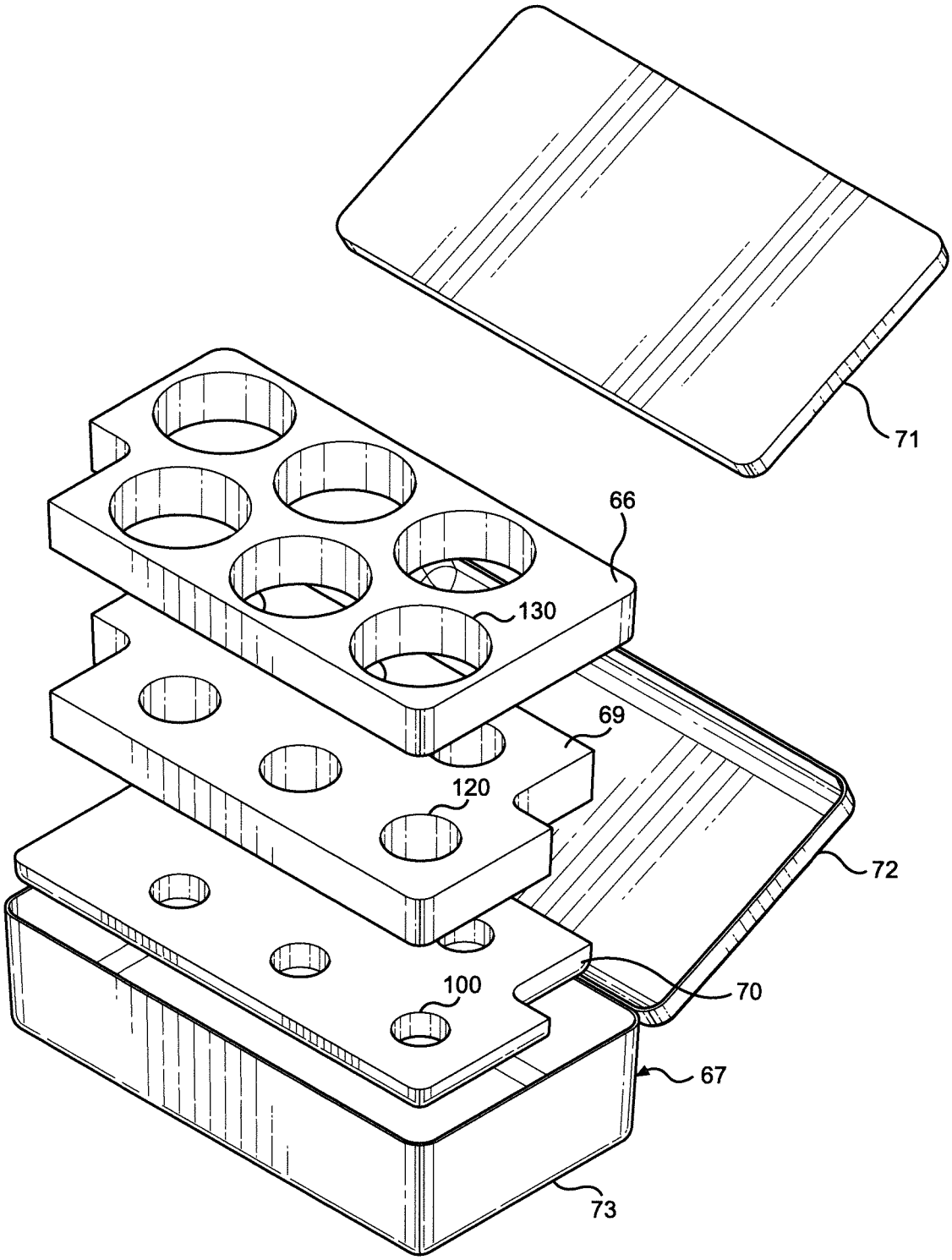
FIG. 9 is an exploded view of the case shown in FIG. 8 without the base units.
Figure 10:
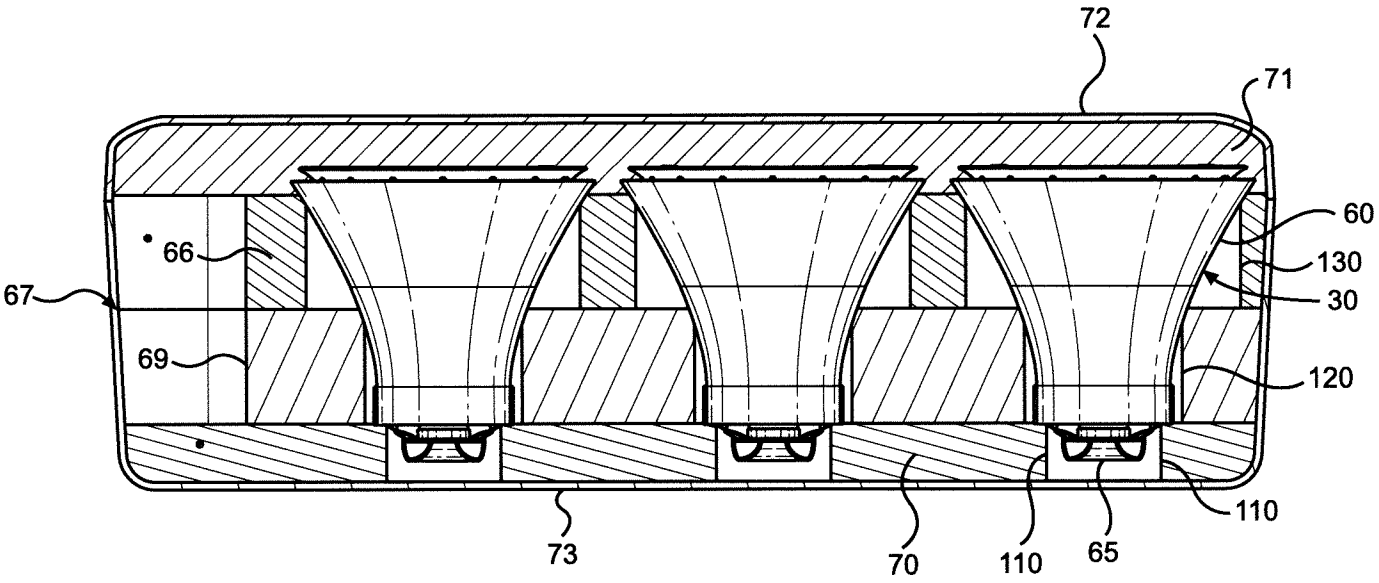
FIG. 10 is a cutaway view of the case shown in FIG. 8, shown with base units.
Figure 11:
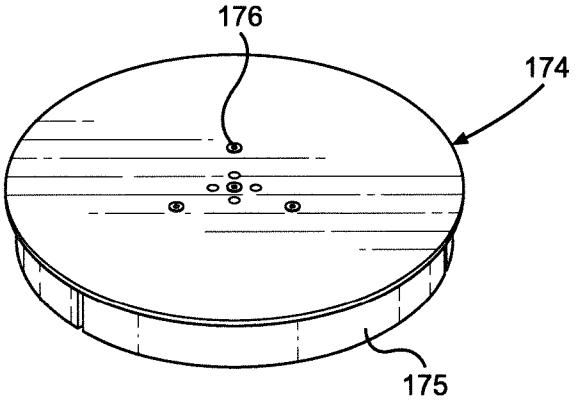
FIG. 11 is an isometric view of a buoyant platform used with the inflatable decoration of FIG. 1.

FIGS. 8-10 show several views of a carrying case 67 having and upper insert 68 and a middle insert 69. Carrying case 67 is preferably made of a hard protective material. The inserts 67 and 68 are shaped to contain and support six base units 30 as shown in FIG. 8. An exploded view of carrying case 67 is shown in FIG. 9, wherein a lower insert 70 and a top insert 71 are also shown. A lid 72 is attached to a base 73 of carrying case 67 in a hinged manner.

The operation of the overall inflatable system will now be described with initial reference to FIGS. 8-10. Carrying case 67 is first opened as shown in FIG. 8 and then insert 70 is placed in base 73. Lower insert 70 is provided with six similar holes, one of which is labeled 100 and arranged to receive diffuser 65 of base unit 30. Lower insert 70 is preferably made of polyurethane foam, but may be made with any resilient material that will protect base unit 30 from damage during transit. Hole 100 preferably provides a clearance 110 so that diffuser 65 does touch lower insert 70, as shown in FIG. 10. Next middle insert 69 is placed on top of lower insert 70. Middle insert 69 is preferably made of the same or similar material as lower insert 70. Middle insert 69 is also provided with six holes generally aligned the respective holes in the lower insert, with hole labeled 120 being aligned with hole 100 of lower insert 70. Next, upper insert 66 is placed on top of middle insert 69. Upper insert 66 is provided with yet another set of holes which are also aligned with respective holes on middle and lower inserts 69, 70. Note hole 130 is aligned with holes 120 and 100. Finally, top insert 71 is placed in lid 72 and then case 67 is ready to receive six base units, one of which is labeled 30.

Six base units are placed in the holes of the inserts. The base units can be charged by supplying power to jack 50 to charge battery pack 53 before or after placement in case 67. Once the base units are charged, the lid 72 is closed. As shown in FIG. 10, base unit 30 engages upper insert 66 and middle insert 69 with upper housing 60 in order to securely hold base unit 30 in place during transit while protecting diffuser 65 from breakage.

When case 67 arrives at an event site, the base units are removed. Rotating hook 43 is held in a stored position because of magnets 43. Next, inflatable element 20 is attached to upper housing 60 of base unit 30 at a top rim 155. Base unit 30 is then turned on by switch 49. Base unit 30 is placed on a flat surface 150, as best seen in FIG. 3, so that bumpers 66 engage surface 150 and hold base unit 30 in place. A remote-control unit 160 is then used to communicate with printed circuit board 51 of base unit 30. Battery pack 53 supplies power to LED bulb 64 which provides light to inflatable element 20 through diffuser 65. Also, battery pack 53 provides power to fan 57 which sucks air from finned inlet 58, as shown by arrow 166 in FIG. 3, through hole 167 in fan housing 56. The air then passes through fan 57 and up past rim 155 into inflatable element 20. The air pressure causes inflatable element 20 to expand into a relatively rigid configuration. As shown in FIG. 1 inflatable element 20 has numerous conical points forming the star shape but, again, numerous other shapes could be employed.

As indicated above, remote-control unit 160 is preferably employed to control the decoration 10. The light source (bulb 64) produces different colors of light and the controller (printed circuit board 51) is further configured to enable a user to select one of the different colors of light with remote-control unit 160. In addition, controller 51 is further configured to turn decoration 10 on or off based on commands received from remote control 160. Other options such as having the colors rotate or dim are also controlled by remote-control unit 160. The light source includes an LED based lighting bulb 64 configured to illuminate inflatable element 20 to provide complete lighting coverage and illumination of inflatable design element 10 with multiple solid color choices, as well as color effect options which, once again, are controlled remotely.

In alternative mounting arrangements, a slightly different procedure is used. When decoration 10 is to be suspended, hook 43 is placed in a deployed configuration as shown in FIG. 6 and decoration 10 is suspended from a support 170 as seen in FIG. 7. While support 170 is shown as a hook, any support may be employed to suspend inflatable decoration 10 from a ceiling or the like. When decoration 10 is to be placed on water, a floating platform 174 is employed. Floating platform 174 has a plurality of floats 175 made of buoyant material. Floating platform 174 also has magnets 176 which cooperate with magnets 48 on inflatable decoration 10 to hold inflatable decoration 10 securely to floating platform 174. In the floating configuration, inflatable decoration 10 may be placed on any body of water, such as a pool or pond.

As can be seen from the above discussion there is provided an inflatable decoration that does not require a running power feed to each of the inflatable elements and therefore eliminates this time consuming, cumbersome and costly arrangement. Indeed, the inflatable elements described herein can be used in places, such as on pools or lakes, that is not possible with the prior art arrangements.

Although described with reference to preferred embodiments, it should be readily understood that various changes or modifications could be made to the invention without departing from the spirit thereof. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. In general, the invention is only intended to be limited by the scope of the following claims.

The invention claimed is:

1. An illuminated inflatable decoration comprising:

a base unit including a housing, at least one battery located in the housing, a fan arranged to draw power from the at least one battery, and a light source arranged to draw power from the at least one battery;

a decorative inflatable element having a decorative shape removably connected to the base and configured to be expanded into a semi-rigid shape when filled with pressurized air from the fan; and a controller configured to receive commands from a remote-control unit and to control the operation of the fan and the light source, wherein the housing has a rim shaped as a ring and the housing is configured to direct a flow of the pressurized air around the light source and into the decorative inflatable element.

2. The inflatable decoration of claim 1, wherein the base unit has a bottom surface configured to be mounted on a flat surface and an upper surface with an airtight seal connected to the inflatable element, wherein the fan is a centrifugal fan, the base unit has a finned inlet configured to direct air to the fan.

3. The inflatable decoration of claim 1 further comprising a folding hook mounted to the base unit and configured to connect to a support for hanging the inflatable decoration in a deployed position extending away from the base and configured to be positioned in a stowed position against the base unit whereby the inflatable decoration may be mounted on the flat surface.

4. The inflatable decoration of claim 1 further comprising a floating support having a top surface and at least one magnet, the base unit having at least one magnet configured to magnetically mount the base to the floating support by interacting with the at least one magnet in the floating support.

5. The inflatable decoration of claim 1 further comprising a plurality of interchangeable design covers, and wherein any one of the plurality of interchangeable design covers may be removably attached to the base.

6. The inflatable decoration of claim 5 wherein the at least one battery is at least one rechargeable battery, providing at least 8 hours of operation for the light source and the fan before requiring recharging.

7. The inflatable decoration of claim 6 wherein the light source produces different colors of light and the controller is further configured to enable a user to select one of the different colors of light with the remote-control unit.

8. The inflatable decoration of claim 7 wherein the controller is further configured to turn the inflatable decoration on or off based on commands received from the remote control.

9. The inflatable decoration of claim 8, wherein the light source includes an LED based light source configured to illuminate the inflatable element with the different colors.

10. The inflatable decoration of claim 9, further comprising a diffuser, mounted over the light source for diffusing light emitted from the light source and wherein the rim is configured to direct the pressurized air around the diffuser.

11. The inflatable decoration of claim 10, wherein the inflatable element includes a fire retardant inflatable fabric and has a star shape.

12. The inflatable decoration of claim 10, further comprising, in combination, a carrying case for the inflatable decoration, said carrying case including:

an outer shell made of a hard protective material; and an insert supporting the illuminated inflatable decoration, wherein the insert includes a lower insert with a hole configured to provide a clearance for the diffuser, a middle insert, placed upon the lower insert and configured to support an upper housing of the decoration and an upper insert configured to support a lower housing of the decoration.

13. The inflatable decoration of claim 12, wherein the insert is made of a polyurethane foam and includes six holes, with each hole configured to store the inflatable decoration.

14. A method for displaying an illuminated inflatable decoration including a base unit having a housing, at least one battery located in the housing, a fan arranged to draw power from the at least one battery, and a light source arranged to draw power from the at least one battery, and a decorative inflatable element removably connected to the base, said method comprising:

mounting the base unit;

expanding the decorative inflatable element into a semi-ridged decorative shape, wherein the expanding inflatable element includes sending commands from a remote-control unit to the controller to operate the fan thus turning on the fan to direct a flow of pressurized air along the housing of the base and out through a hole formed by a rim of the housing, wherein the air passes a diffuser mounted in the hole, and filling the element with pressurized air from the fan.

15. The method according to claim 14, wherein mounting the base unit includes mounting the base unit on flat surface.

16. The method according to claim 14, wherein mounting the base unit includes hanging the inflatable decoration by unfolding a hook attached to the base and hanging the hook on a support whereby the decoration is suspended from the support by the hook.

17. The method according to claim 14, wherein mounting the base unit includes magnetically securing the decoration to a floating support.

18. The method according to claim 14, further comprising:

selecting a design cover from a plurality of interchangeable design covers; and removably attaching the design cover to the base.

19. The method according to claim 14, further comprising turning on the light source of the inflatable decoration with the remote control and wherein turning on the fan directs the flow of pressurized air through a finned inlet in the base.

20. The method according to claim 19, further comprising diffusing light emitted from the light source into the inflatable element.

* * * * *